US005338629A

United States Patent [19]

Hibbard et al.

[11] Patent Number: 5,338,629

[45] Date of Patent: Aug. 16, 1994

[54] METHOD OF MAKING PHOTO STENCILS FOR CATHODE RAY TUBE SCREEN DEPOSITION

[75] Inventors: Robert A. Hibbard, Elburn; Thomas M. Remec, Des Plaines, both of Ill.

[73] Assignee: Zenith Electronics Corporation, Glenview, Ill.

[21] Appl. No.: 906,615

[22] Filed: Jun. 30, 1992

Related U.S. Application Data

[63] Continuation-in-part of Ser. No. 655,561, Feb. 13, 1991, Pat. No. 5,158,491.

[51] Int. Cl.[5] ..... G03C 5/00

[52] U.S. Cl. ..... 430/23; 430/5; 430/24; 430/25; 445/52; 445/66

[58] Field of Search ..... 430/23, 24, 25, 5, 321; 445/66, 52

[56] References Cited

U.S. PATENT DOCUMENTS

| | | | |
|---|---|---|---|
| 3,973,964 | 8/1976 | Lange | 96/36.1 |
| 4,248,947 | 2/1981 | Oikawa | 430/5 |
| 4,475,797 | 10/1984 | Park | 354/1 |
| 5,158,491 | 10/1992 | Fendley et al. | 430/24 |

*Primary Examiner*—Steve Rosasco
*Attorney, Agent, or Firm*—Roland W. Norris

[57] ABSTRACT

A method is disclosed for manufacturing photostencils used in screening the faceplates of color cathode ray tubes. The photostencils are produced as progeny from a parent stencil photo plotted according to the dictates of a proximity photoprinting process in conjunction with the electron optical characteristics of the operational CRT. A rectangular beam is used for radiating light through the pattern of features on the parent stencil onto the photoresist of the progeny stencil. As a result, the features of the progeny stencil differ in size or shape or both, from those of the parent stencil.

20 Claims, 3 Drawing Sheets

METHOD OF MAKING PHOTO STENCILS FOR CATHODE RAY TUBE SCREEN DEPOSITION

CROSS REFERENCE TO RELATED APPLICATIONS

This application is a continuation-in-part of application Ser. No. 655,561, filed Feb. 13, 1991, U.S. Pat. No. 5,223,179.

BACKGROUND OF THE INVENTION

1. Field of the Invention

The present invention relates to photolithographic deposition of CRT screens, including formation of black matrices and phosphor deposits. The present invention relates more specifically to photostencils used in near contact to the photosensitized faceplate to provide for interchangeable mask and screen type cathode ray tubes (CRTs).

2. Discussion of the Related Art

Those familiar with the art of phosphor screen application to the faceplate of a display device, such as the common color cathode ray tube, are aware of the advantages to be gained by utilizing near contact photoexposure techniques. Such advantages are set forth in the parent application, U.S. Ser. No. 07/655,561, filed Feb. 13, 1991, now U.S. Pat. No. 5,158,491. The parent application is herein incorporated by reference to avoid lengthy exposition of background unnecessary to the exposition of the present invention for those ordinarily skilled in the art.

Briefly, however, the near contact photoexposure screening technique, hereinafter called "near contact printing," utilizes a standardized photostencil placed very close to the photosensitive coating on the CRT faceplate to be exposed. The result is that each faceplate screened by near contact printing is alike in feature size and location to a high degree. This enables likewise standardized shadow masks to be fitted interchangeably in operable relation to the standardized screens.

As set forth in the parent application, an ideal photostencil, called the "parent stencil", for use in near contact printing is made, preferably by photoplotting. The pattern of photostencil features is dictated by the electron-optic characteristics of the operable CRT which govern the paths of the electron beams used to excite the phosphor deposits on the screen. This method of parent stencil generation is time consuming and expensive. The parent photostencil, or duplicates thereof, used in the screen exposure apparatus have a fixed photo-stencil pattern, the discrete elements, or light-passing apertures, of which will be referred to as the aforementioned "features."

Thus, the parent stencil is fixed in an idealized feature pattern but has only one feature size and shape. However, the requirements of the screen features in a given model of tube may change from time to time, due, perhaps, to changing tube specifications or to take advantage of other manufacturing efficiencies or cost saving. Thus, to introduce flexibility of feature size and/or shape to the CRT screen without generating a new parent stencil is highly desirable.

Since the parent stencil cannot be economically used in a factory environment, due to its high cost and susceptibility to damage, it is necessary to form progeny stencils, i.e., working copies therefrom. Because there is no need to duplicate electron beam optics with the near contact exposure apparatus, the parent stencil can be made in any manner necessary to create a working progeny stencil of proper pattern for exposure of the CRT screen. The present invention therefore, teaches the formation of a parent stencil proportional and featured so as to allow near contact print generation of the working progeny thereby enabling changes in the feature size and shape while retaining the feature pattern dictated by electron beam landings in the CRT. Control of the generation of progeny to maintain feature acuity is, of course, central to the present invention.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DETAILED DESCRIPTION OF THE PREFERRED EMBODIMENT

Figure 1A:
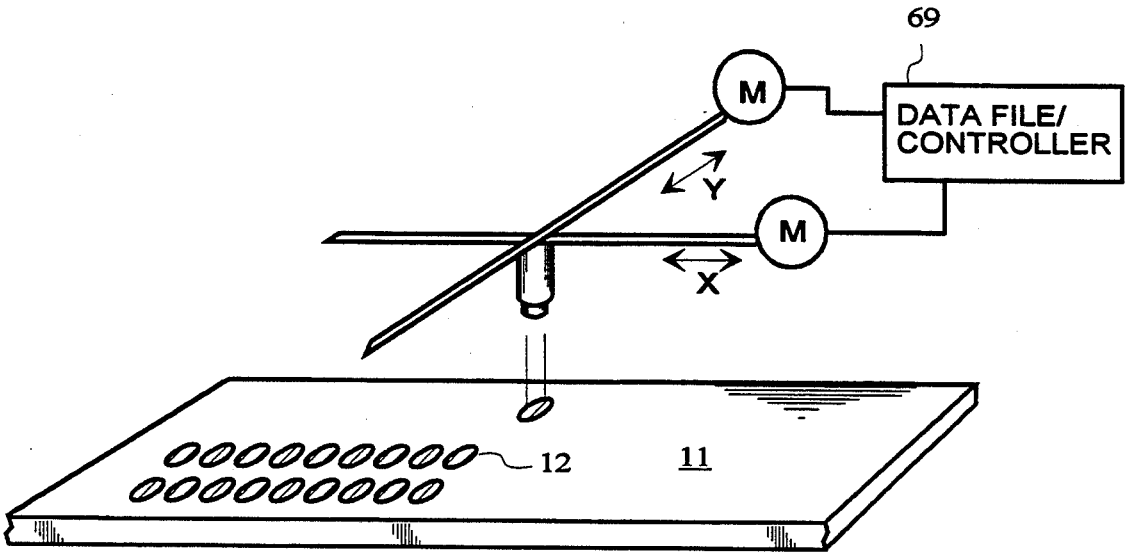
FIG. 1A illustrates formation of the parent stencil.

As seen in FIG. 1A, the parent stencil 11, photoplotted, as per the parent invention, according to the dictates of the electron-optics of an operational CRT, has a fixed pattern of light-transmitting features 12. Unlike the embodiment claimed in the parent application, the parent stencil of the present invention is made to be smaller in feature size and pattern than the progeny stencil actually used in the light house. These features are of fixed size and shape, preferably, though not necessarily, round and of smaller size and pattern than the ultimately required working progeny stencil size necessary to expose finished screen. This is due to the intrinsic enlargement of light images originating in a point source passing through a photostencil and landing on an imaging plane spaced therefrom. Mathematical expression of such enlargement and the concomitant spacing of the exposure system elements is within the skill of the ordinary artisan. The features 12 in the parent stencil 11 are described as being round windows for creating a dot screen.

Figure 1B:
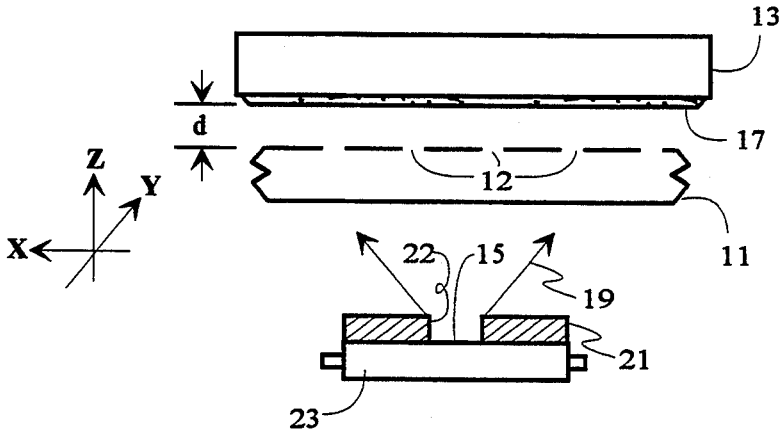
FIG. 1B is a side view of progeny stencil formation.

With reference now to FIG. 1B, a parent stencil 11 having light transmitting features 12 is depicted with progeny stencil blank 13 on one side thereof, and at a predetermined distance from, the parent stencil 11. The distance "d" may be in the range of 0.001" to 0.100" in order to maintain maximal image acuity. Consideration must be given to appropriate selection of the distance "d" in conjunction with the spacing required for the ultimate placement of the progeny stencils from the photosensitive faceplate of the CRT, as explained above. A nominal distance of 0.020" is recommended in order to keep the penumbra effects controlled while attaining the desired elongation of spot size. On the opposite side of the parent stencil 11, from the progeny stencil blank 13 is located an exposure light source 15.

The progeny stencil blank 13 is coated with a photoresist 17, preferably, though, not necessarily, of the negative type. The photoresist 17 is exposed to the light 19 from the lamp 15, through a shader plate (not shown) to normalize light intensity and to form the progeny stencil pattern having different shape/sizes of features than the parent stencil 11 as further explained below.

Figure 2:
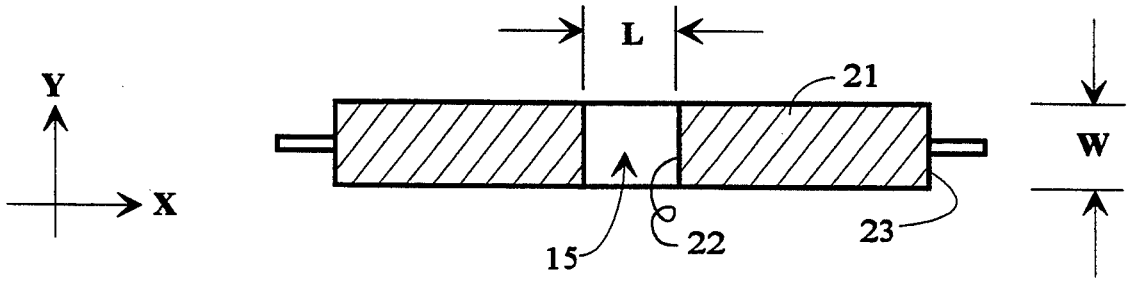
Fig. 2 (Prior Art)
FIG. 2 and 3 illustrate known light sources for photoexposure of CRT screens.
Figure 3:
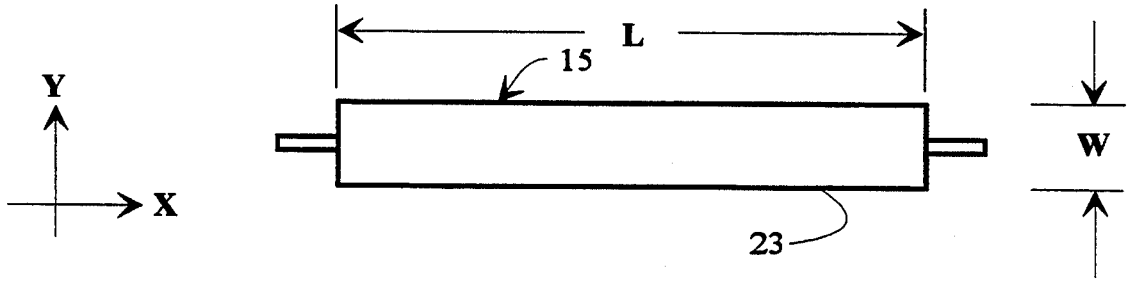
Fig. 3 (Prior Art)

A known type of exposure light source 15 for photodeposition of CRT screens is created by placing an opaque, apertured member 21 having a light transmitting aperture 22 over a standard screen exposure lamp 23. The lamp 23 may be a commercially available one kilowatt high-pressure mercury vapor lamp, such as lamp model #BHA704C supplied by ORC Manufacturing Company Limited of Tokyo, Japan. As seen in FIG. 2, the light source created for exposing a dot screen type image of the type shown in FIG. 1A is generally square. That is, the aperture has a length "L" equal to the apparent width "W" of the light source from the lamp 23 in order to approximate a point source of light. To expose a line type of image popular in the use of entertainment type televisions, one would ordinarily use a known line type light source as seen in FIG. 3. That is, the length "L" is many times the width "W" of the light source.

Figure 4:
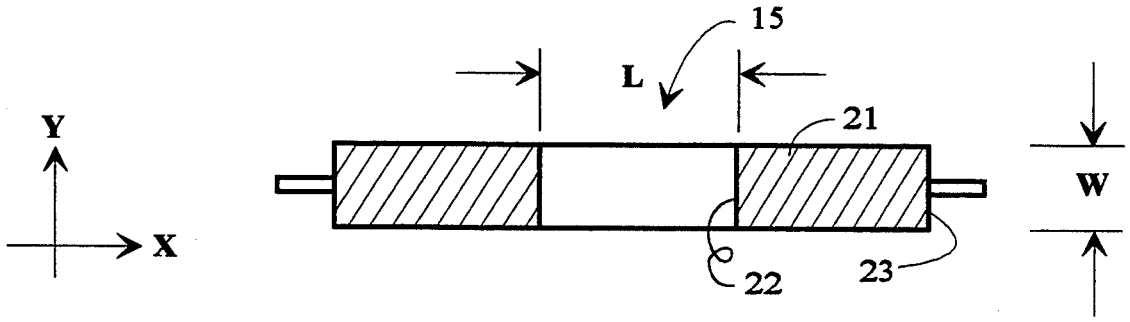
FIG. 4 illustrates a light source according to the present invention.
Figure 5:
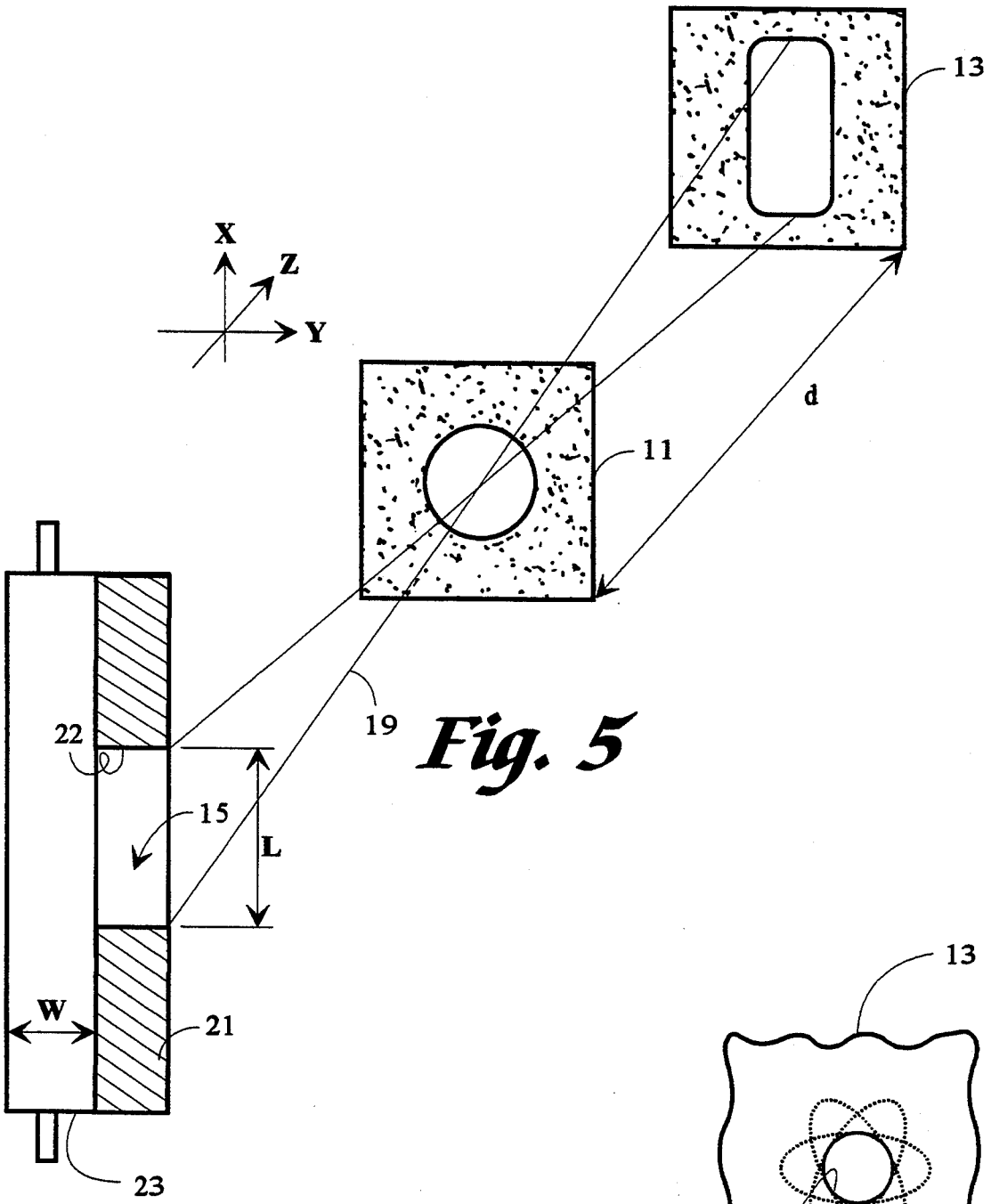
FIG. 5 illustrates the principle of the present invention.

As seen in FIG. 4, the light source 15 according to the present invention, is made "over-square" or "rectangular" preferably by making the length "L" of the aperture 22 placed over the lamp 23 greater than the width "W". Use of this rectangular light source results in an oblong progeny feature 29 being exposed on photoresist 17 (FIG. 5). Use of a square light source merely recreates the same master feature shape on the progeny while use of a true line source may over-elongate the features of the progeny, resulting in merging of the features into one another. Thus, by changing the length "L" of the aperture 22 the light source 15 may be changed to produce different degrees of feature elongation on the progeny.

Figure 6:
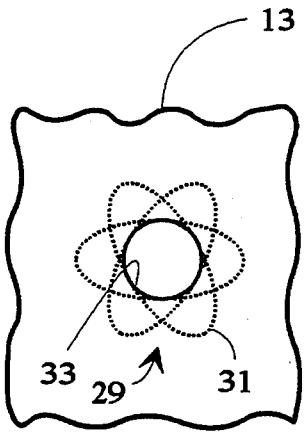
FIG. 6 illustrates a multiple exposure of a progeny stencil feature.

As seen in FIG. 6, the shape of the progeny feature 29 may be further varied by using multiple exposures and rotation of the lamp. The effect of the rotation of the lamp 23 is indicated in FIG. 6, in which a step sequential rotation of lamp 23 in 120° increments results in a series of multiple exposures on different axis to produce a six sided "clover leafed" feature configuration 31 on the progney stencil 13. The projected circumference of the feature in parent stencil 11, by which the clover leaf pattern 31 is produced, is indicated by the inner circle 33. It will be appreciated that a variety of configurations of progeny feature may be made by varying the aspect ratio of the light source 15 and the sequential rotations of the lamp 23.

It will also be recognized that the techniques described herein may be applied to the near contact printing of the screen itself. The screen will, in such case, be treated as a progeny of the working photostencil used in the production photoexposure apparatus. Such an alternative may, for example, be used to achieve "on the fly" production process flexibility of screen feature geometry.

Rather than rotating the lamp step—sequentially, it may be smoothly rotated through 360°, to provide a window that is circular and enlarged. A slightly longer exposure time is required for good acuity. Also, according to the present invention, the lamp 23 may be held stationary and the assembly comprising the parent stencil and the progeny stencil blank may be rotated as a unit about a common axis.

Exposure time depends on factors such as the distance between the lamp 23 and the parent stencil 11, the distance "d" between the parent stencil 11 and the progeny stencil 13, the sensitivity of the photoresist 17, and of the intensity of the source. By way of example, exposure times for progeny formation may be in the range of 2 to 60 seconds.

The benefits of the invention include:

1. a single parent stencil can be the basis for many different feature sizes or shapes, or both, in progeny stencils;
2. the positions of the feature in a progeny stencil will correspond in precise proportionality with the positions of the features in the parent stencil, as required by the electron-optics of the operational CRT;
3. a change in the shape of the features in a progeny stencil does not require a substantial increase in exposure times, but only a lamp with a slightly longer aperture;
4. in a dot screen system, if the features must be made oblong, they can be made so on any axis.

The method according to the present invention can also be used to form progeny stencils having different slot or slit features than a parent stencil for use in forming line screens.

While particular embodiments of the invention have been shown and described, it will be readily apparent to those skilled in the art that changes and modifications may be made in the present invention without departing from the spirit thereof, and therefor, the purpose of the appended claims is to cover all such changes and modifications as fall within the true spirit and scope of the invention.

We claim:

1. A method of manufacturing progeny photostencils useful for interchangeable proximity print screening of the faceplates of phosphor displays, comprising:

a) providing a parent stencil having a predetermined pattern of features, the features having a predetermined configuration;

b) providing photoresist-coated progeny stencil blank, and locating the progeny stencil blank a predetermined distance in proximity to the parent stencil;

c) exposing the photoresist with a rectangular light source radiated through the parent stencil;

d) developing the exposed photoresist; whereby a pattern of features is formed to provide a progeny stencil in the predetermined pattern of the parent stencil, the features in the progeny stencil differing in size or shape, or both, from those of the parent stencil.

2. The method according to claim 1, including varying the orientation of the rectangular light source falling on the photoresist.

3. The method according to claim 2 including rotating the light source to vary the orientation of the light source long axis falling on the photoresist.

4. The method according to claim 3 including multiply exposing the photoresist by rotating the rectangular light source step-sequentially in predetermined increments.

5. The method according to claim 4 including sequentially rotating the rectangular light source in two 180° increments.

6. The method of claim 3 including smoothly rotating the rectangular light source 360°.

7. The method according to claim 1 including spacing the parent stencil from the progeny stencil blank a distance in the range of 0.001 inch to 0.100 inch.

8. The method of claim 7 including spacing the parent stencil from the progeny stencil blank a distance of about 0.020 inches.

9. The method according to claim 1 including providing the parent stencil with a predetermined configuration of features in the form of a dot screen.

10. The method according to claim 1 including providing the parent stencil with a predetermined configuration of features in the form of a line screen.

11. A method of applying a screen to a CRT faceplate comprising, a) providing a photostencil having a predetermined pattern of features, the features having a predetermined configuration;

b) providing a photosensitive coating suitable for screen formation on the CRT faceplate;

c) placing the photostencil a predetermined distance in proximity to the photosensitive coating;

d) exposing the photosensitive coating with a rectangular light source radiated through the photostencil; and e) developing the exposed photoresist; whereby a pattern of features is formed on the CRT faceplate in a pattern coincident with the predetermined pattern of the photostencil, but having different feature sizes, or shapes, or both.

12. The method according to claim 11, including varying the orientation of the rectangular light source falling on the photosensitive coating.

13. The method according to claim 12 including rotating the light source to vary the orientation of the light source long axis falling on the photosensitive coating.

14. The method according to claim 13 including multiply exposing the photosensitive coating by rotating the rectangular light source step-sequentially in predetermined increments.

15. The method according to claim 14 including sequentially rotating the rectangular light source in two 180° increments.

16. The method of claim 13 including smoothly rotating the rectangular light source 360°.

17. The method according to claim 11 including spacing the photostencil from the coated CRT faceplate a distance in the range of 0.001 inch to 0.100 inch.

18. The method of claim 17 including spacing the parent photostencil from the CRT faceplate a distance of about 0.020 inches.

19. The method according to claim 11 including providing the photostencil with a predetermined configuration of features in the form of a dot screen.

20. The method according to claim 11 including providing the photostencil with a predetermined configuration of features in the form of a line screen.

* * * * *